United States Patent [19]

Rubin

[11] Patent Number: 4,967,331

[45] Date of Patent: Oct. 30, 1990

[54] HOLDER FOR GLASS ELECTRIC LAMP DOME

[76] Inventor: Hector Rubin, Ave. Nazca 2799/2005, 1417 Capital Federal, Argentina

[21] Appl. No.: 468,044

[22] Filed: Jan. 22, 1990

[51] Int. Cl.[5] ..... F21V 17/06

[52] U.S. Cl. ..... 362/433; 362/452

[58] Field of Search ..... 362/452, 453, 433–448; 248/342, 343

[56] References Cited

U.S. PATENT DOCUMENTS

| | | | |
|---|---|---|---|
| 1,753,374 | 4/1930 | Guth | 362/433 |
| 2,735,000 | 2/1956 | Wilson et al. | 362/433 |
| 2,887,569 | 5/1959 | Frei | 362/433 |
| 3,108,753 | 10/1963 | Coffey | 362/433 |
| 3,218,451 | 11/1965 | Muller et al. | 362/433 |
| 3,283,145 | 10/1966 | Muller et al. | 362/433 |
| 3,312,817 | 4/1967 | Erhardt et al. | 362/433 |
| 3,903,411 | 9/1975 | Klein et al. | 362/433 |

FOREIGN PATENT DOCUMENTS

| | | | |
|---|---|---|---|
| 106578 | 5/1942 | Sweden | 362/433 |
| 189677 | 6/1964 | Sweden | 362/433 |
| 285615 | 6/1953 | Switzerland | 362/433 |
| 680043 | 10/1952 | United Kingdom | 362/433 |

*Primary Examiner*—James C. Yeung

*Attorney, Agent, or Firm*—Paul R. Wylie

[57] ABSTRACT

A holder for detachably mounting a glass electric lamp dome which includes a pair of dome holding arms mounted to a lever arm which in turn is pivotally mounted on a base plate. The lever arm and the dome holding arms are actuated by a finger engageable lever formed as part of one of the dome holding arms and having a finger engageable terminus at the end opposite the end attached to the pivot arm. A feature is spring biasing means connecting the base plate and the lever arm to continuously urge the dome holding arms outwardly in dome holding locking position unless the finger engageable dome holding arm is moved inwardly. Another feature is lock means associated with said finger engageable dome holding arm to premit the locking of said mechanism in a dome disengaging position so that the dome can be removed and replaced.

4 Claims, 4 Drawing Sheets

HOLDER FOR GLASS ELECTRIC LAMP DOME

BACKGROUND OF THE INVENTION

This invention relates generally to releasable mounting means for glass electric lamp globes or domes.

In known releasable retaining holders of the type which are mounted on the ceiling or on a wall, the glass dome is held by means of three or more threaded screws, each of which has to be unthreaded to permit removal and replacement of the glass dome when changing a light bulb.

In prior art arrangements which use mechanisms other than the conventional multi-screw arrangement described above, there have been proposed flat sheet spring retaining means such as in U.S. Pat. No. 3,312,817; a plurality of tilting levers acutuated by the glass dome during installation of the latter as shown in U.S. Pat. No. 3,903,411; and, dome retaining extending arms actuated by a gear drive as shown in Swedish Patent No. 106,578 as examples.

All of the foregoing arrangements have been unsatisfactory due to mechanical problems, complications of design caused by the requirement for many moving parts, and the absence of a positive locking feature whereby the dome cannot be inadvertently released once it is firmly in place.

Accordingly, it has been an object of this invention to provide a holder for detachably mounting a glass electric lamp dome that can be easily actuated to release or attach the dome and which requires only a few moving parts capable of easy manufacture and assembly and economy by elimination of precision parts or fasteners.

According to this invention, there has been provided a holder for detachably mounting a glass electric lamp dome which includes a pair of dome holding arms mounted to a lever arm which in turn is pivotally mounted on a base plate. The lever arm and the dome holding arms are actuated by a finger engageable lever formed as part of one of the dome holding arms and having a finger engageable terminus at the end opposite the end attached to the pivot arm. A feature of the invention is spring biasing means connecting the base plate and the lever arm to continuously urge the dome holding arms radially outwardly in dome holding locking position unless the finger engageable dome holding arm is moved inwardly. Another feature of the invention is lock means associated with said finger engageable dome holding arm to permit the locking of said mechanism in a dome disengaging position so that the dome can be removed and replaced.

The invention will be more fully described with reference to the drawings.

DETAILED DESCRIPTION OF THE INVENTION

Figure 1:
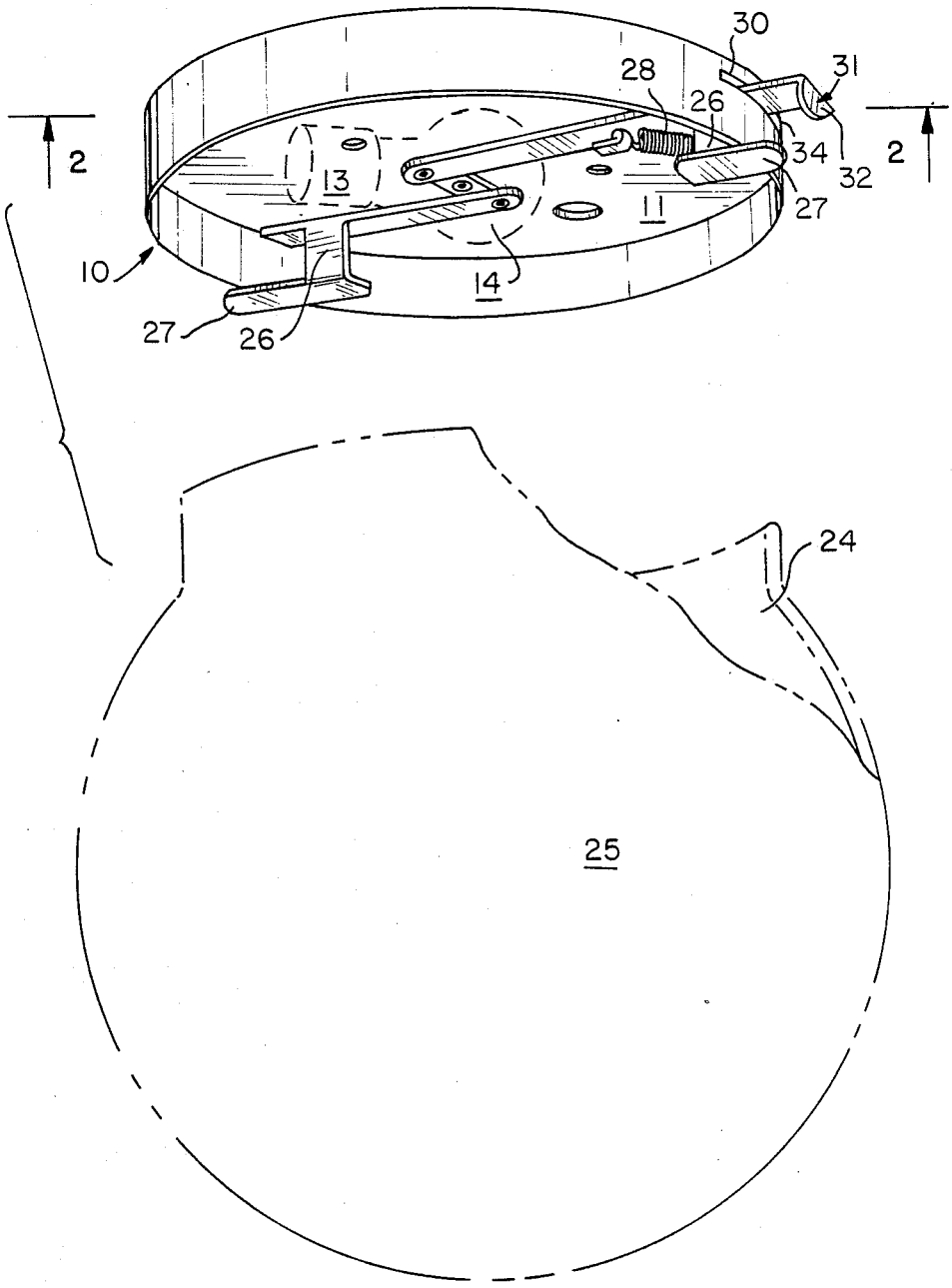
FIG. 1 is a view and perspective showing the holder of the invention as attached to a ceiling with an electrical bulb socket, the light bulb and the dome shown in phanthom lines.

According to the invention, there is provided a holder 10 which consists of a base plate 11 for holding a lamp 12, the latter of which includes a socket 13 and bulb 14. A lever arm 15 is mounted for rotation at the center of base plate 11 by rivet 16. Dome holding arm 17 is mounted for rotation on lever arm 15 by means of rivet and is further mounted on base plate 11 by rivet 19 which moves in slot 20 of the dome holding arm 17.

Dome holding arm 21, like dome holding arm 17, is mounted for rotation at the opposite end of lever arm 15 by rivet 22.

Extending downwardly from dome arms 17 and 21 are dome contact projections 22 and 23 which are adapted to contact and undercut portion 24 of the dome 25. Dome contact projections are formed by downwardly extending wall 26 which are at right angles to outwardly extending dome contact projection terminus 27.

Dome holding arms 17 and 21 are maintained in their radially outer most position by means of tension spring 28 which is fastened by hooks 29 formed as part of dome holding arm 21 and base plate 11 respectively.

Figure 2:
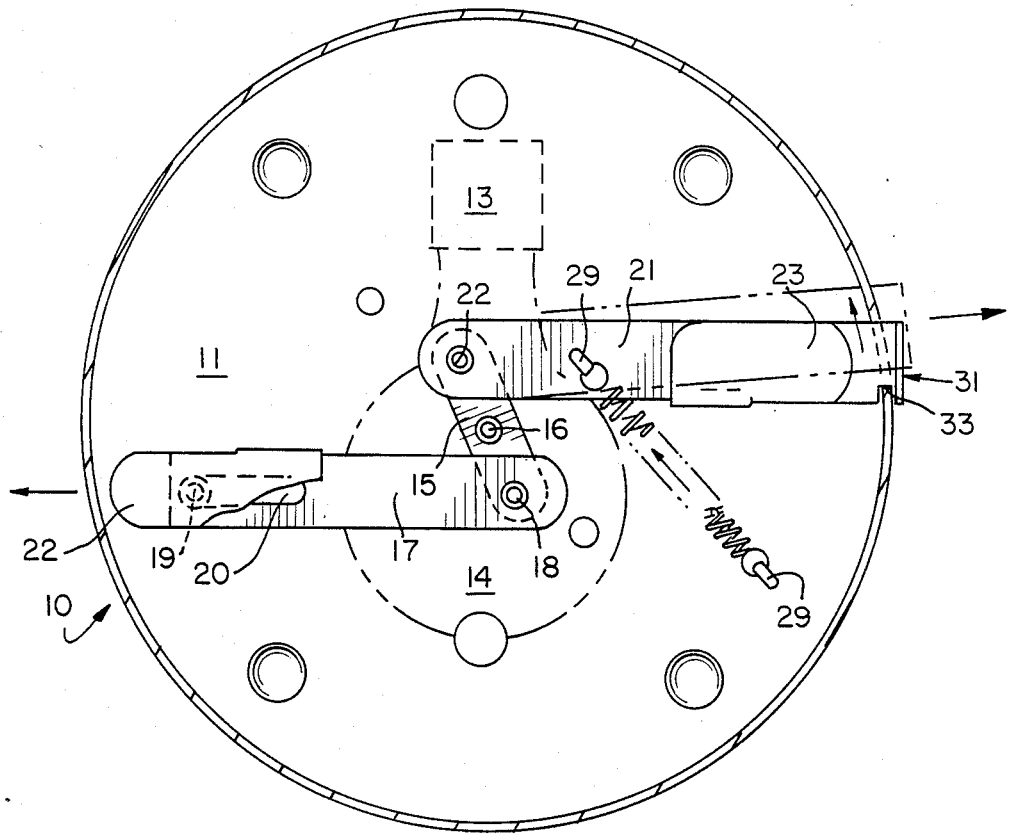
FIG. 2 is a bottom plan view of the holder of FIG. 1 taken looking in direction of the arrows 2—2 on FIG. 1.
Figure 3:
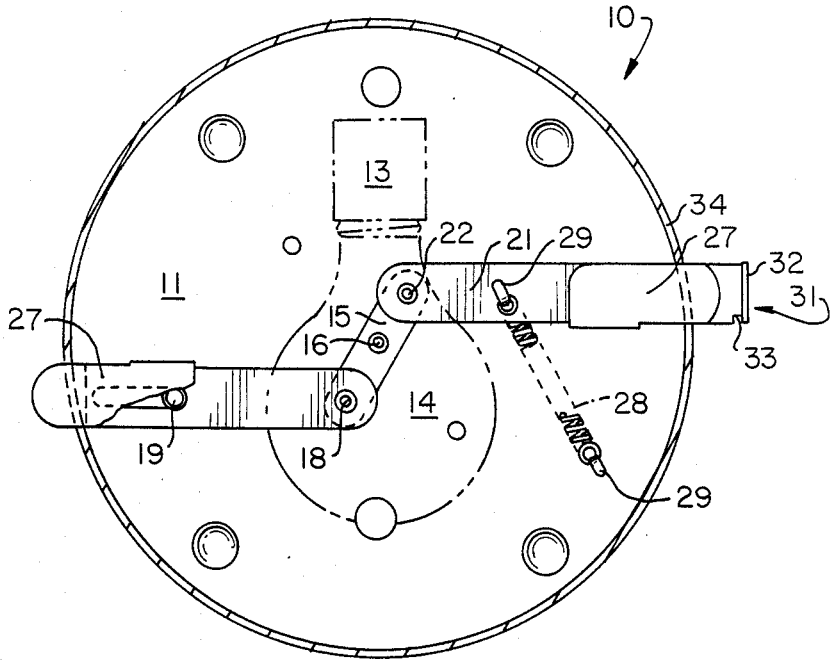
FIG. 3 is a view similar to FIG. 2 showing the holder in a locked position.
Figure 4:
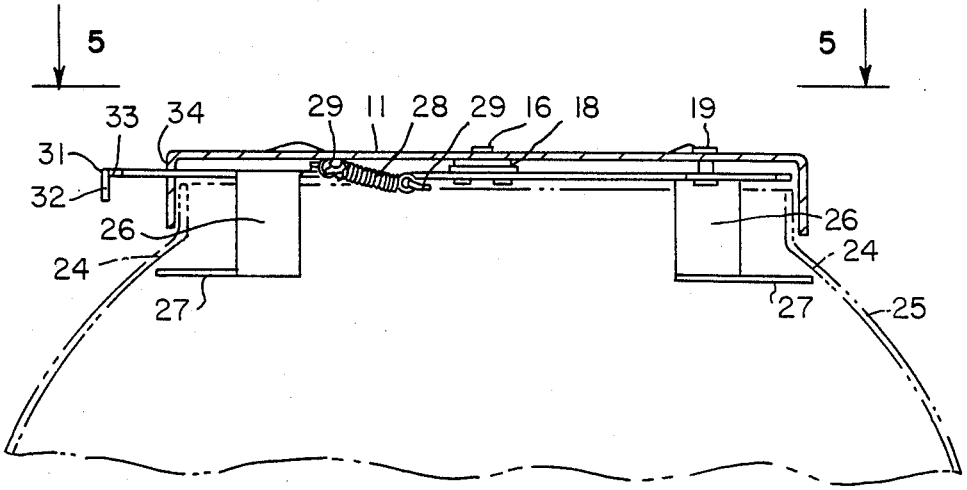
FIG. 4 is a view in cross section taken on line 4—4 of FIG. 3.
Figure 5:
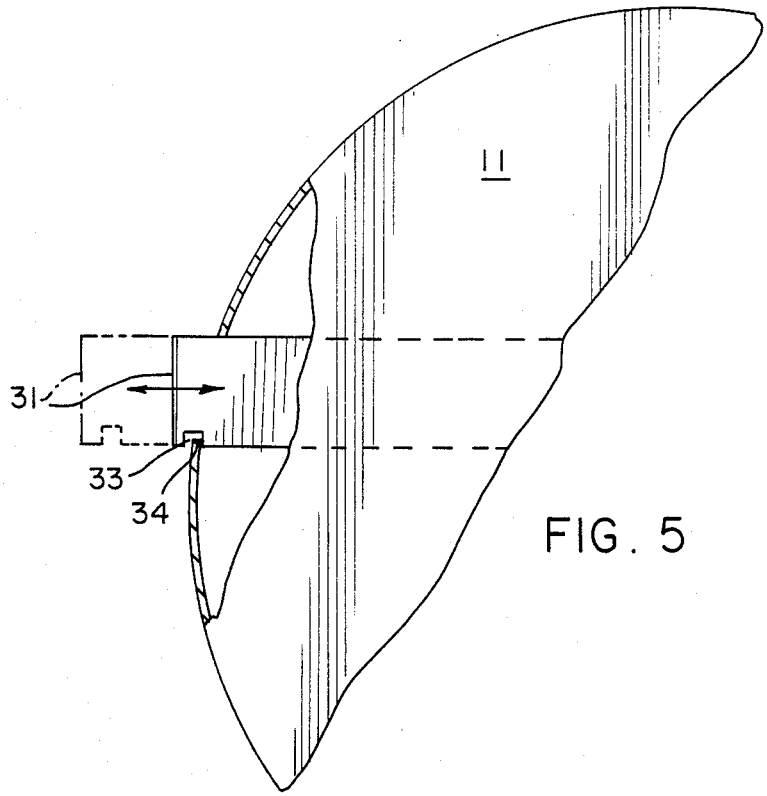
FIG. 5 is a partial plan view taken looking in the direction of the arrows in FIG. 4 with parts of the holder broken away for convenience of illustration showing the locking mechanism of the holder; and, FIG. 6 is a partial perspective view of the holder showing the action of the locking mechanism.
Figure 6:
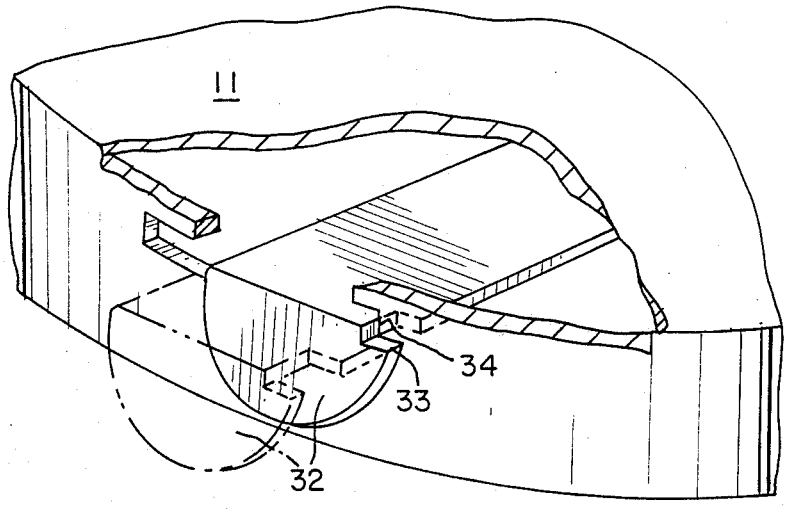

Base plate 11 is provided with a radial opening 30 formed as an elongate slot through which dome holding arm 21 passes. At the end of dome holding arm 21 is a finger grippible dowmwardly extending terminus 31 which comprises a second downwardly extending wall 32. Adjacent said second downwardly extending wall 32 is a rectangular notch 33 adapted to engage the rim 34 of base plate 11 surrounding radial opening 30 to hold dome holding arm 21 in a locked position. The locking is accomplished by moving the dome holding arm inwardly until the notch is aligned with rim 34 surrounding radial opening 30 and then engaging the notch 33 with rim 34 to maintain dome holding arms 21 and 17 in the retractive position shown in FIG. 2. In this position, dome 25 can be removed and replaced.

To again securely mount the dome to base plate 11, finger engageable terminus 31 is moved circumferentially away from rim 34 at the point it is engaged with notch 33 allowing tension spring 28 to exert force on arm 21, lever arm 15 and arm 17 to move dome engaging portions 27 radially outwardly to engage the undercut portion 24 of dome 25.

All of the major parts of the holder, including base plate 11, dome holding arms 17 and 21, and lever arm 15 can be formed of sheet metal.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A holder for detachably mounting a glass electric dome of the type having an inwardly directed rim portion around an opening thereof comprising:

a. a base plate including a downwardly extending peripheral flange having a slotted opening therein;

b. a lever arm pivotally mounted on said base plate;

c. two dome holding arms attached to opposite ends of said lever arm and movable radially inwardly and outwardly from a dome locking position to a dome releasing position when said pivot arm is rotated, one of said dome holding arms having an integral extension thereof, said integral extension having a finger engageable terminus at the end opposite the end attached to said pivot arm for moving said arm to pivot said lever arm, said finger engageable terminus extending through said openings; and d. spring biasing means connecting said base plate and said lever arm to continuously urge said lever to a position where said dome holding arms are moved radially outwardly in dome locking position, said integral extension of said dome holding arm having a notch therein sized to engage said downwardly extending peripheral flange at said slot to provide a lock means to hold said lever arm in a position where said dome holding arms are retracted from said dome holding position.

2. A holder according to claim 1 wherein said dome holding arms are formed of sheet metal with dome contacting portions thereof extending upwardly and outwardly from said arms.

3. A holder according to claim 2 wherein said lever is formed of sheet metal and pivotly mounted to said base by a rivet and said dome holding arms are pivotably mounted to the ends of said dome holding arms by rivets.

4. A holder according to claim 2 wherein said dome holding arms comprise downwards directed wall portions connected to outwardly directed dome gripping fingers.

* * * * *